US011440156B2

(12) United States Patent
Radnezhad et al.

(10) Patent No.: US 11,440,156 B2
(45) Date of Patent: Sep. 13, 2022

(54) MAGNETIC ABRASIVE FINISHING OF CURVED SURFACES

(71) Applicants: Hamid Reza Radnezhad, Isfahan (IR); Peiman Moradi Gharibvand, Isfahan (IR); Hamid Zarepour Firouzabadi, Isfahan (IR); Aminollah Mohammadi, Isfahan (IR)

(72) Inventors: Hamid Reza Radnezhad, Isfahan (IR); Peiman Moradi Gharibvand, Isfahan (IR); Hamid Zarepour Firouzabadi, Isfahan (IR); Aminollah Mohammadi, Isfahan (IR)

(73) Assignee: ISLAMIC AZAD UNIVERSITY OF NAJAFABAD, Najafabad (IR)

( * ) Notice: Subject to any disclaimer, the term of this patent is extended or adjusted under 35 U.S.C. 154(b) by 787 days.

(21) Appl. No.: 16/416,239

(22) Filed: May 19, 2019

(65) Prior Publication Data

US 2019/0270175 A1 Sep. 5, 2019

Related U.S. Application Data

(60) Provisional application No. 62/686,693, filed on Jun. 19, 2018.

(51) Int. Cl.
*B24B 49/10* (2006.01)
*B24B 31/112* (2006.01)
(Continued)

(52) U.S. Cl.
CPC ..... *B24B 29/005* (2013.01); *B24B 1/002* (2013.01); *B24B 1/005* (2013.01); *B24B 31/102* (2013.01); *B24B 31/112* (2013.01); *B24B 49/10* (2013.01)

(58) Field of Classification Search
CPC ..... B24B 1/002; B24B 1/005; B24B 29/005; B24B 31/102; B24B 31/112; B24B 49/10; B24B 49/105
(Continued)

(56) References Cited

U.S. PATENT DOCUMENTS 5,957,753 A * 9/1999 Komanduri ..... B24B 37/02 451/36
7,156,724 B2 * 1/2007 Kordonski ..... F16J 15/43 451/113
8,535,116 B2 * 9/2013 Abe ..... G03G 15/0928 451/103

FOREIGN PATENT DOCUMENTS

CN 104308671 A * 1/2015 ..... B24B 1/005
CN 106392779 A * 2/2017 ..... B24B 1/005
WO WO-2018032659 A1 * 2/2018 ..... B24B 1/00

* cited by examiner

*Primary Examiner* — Eileen P Morgan
(74) *Attorney, Agent, or Firm* — Bajwa IP Law Firm; Haris Zaheer Bajwa

(57) ABSTRACT

A system for magnetic abrasive finishing of a workpiece may include a magnetic abrasive brush that may include a plurality of magnetic/abrasive particles and an electromagnet configured to apply a magnetic field on the plurality of magnetic abrasive particles. The system may further include a first actuating mechanism that may be configured to actuate a rotational movement of the workpiece about a longitudinal axis of the workpiece, a second actuating mechanism that may be configured to actuate a linear movement of the magnetic abrasive brush along a first direction relative to the workpiece, the first direction parallel to the longitudinal axis of the workpiece, a sensor coupled to the magnetic abrasive brush that may be configured to measure a working gap between the magnetic abrasive brush and an outer surface of the workpiece at any given instant. The working gap may be a distance between a center of the
(Continued)

magnetic field and the outer surface of the workpiece along a first axis perpendicular to the longitudinal axis of the workpiece. The system may further include a control unit that may be coupled to the magnetic abrasive brush and may be configured to adjust a magnetic flux density of the magnetic field based on the measured working gap at any given instant.

16 Claims, 6 Drawing Sheets

(51) Int. Cl.
*B24B 29/00* (2006.01)
*B24B 1/00* (2006.01)
*B24B 31/10* (2006.01)

(58) Field of Classification Search
USPC ..... 451/5, 9, 10, 11, 32, 35, 74, 104, 105, 451/106, 113
See application file for complete search history.

MAGNETIC ABRASIVE FINISHING OF CURVED SURFACES

CROSS-REFERENCE TO RELATED APPLICATION

This application claims the benefit of priority from U.S. Provisional Patent Application Ser. No. 62/686,693, filed on Jun. 19, 2018, and entitled "MAGNETIC ABRASIVE FINISHING (MAF) SYSTEM WITH VARIABLE MAGNETIC FIELD FOR EXTERNAL CURVED SURFACES," which is incorporated herein by reference in its entirety.

TECHNICAL FIELD

The present disclosure relates to systems and methods for magnetic abrasive finishing and particularly relates to systems and methods for magnetic abrasive finishing of curved surfaces. More particularly, the present disclosure is related to a system and method for magnetic abrasive finishing of curved surfaces utilizing variable magnetic fields.

BACKGROUND

Precision micro- and nano-finishing processes for production of workpieces with complex geometries and high surface qualities are highly demanded in various technical fields, such as semiconductors, optics, aerospace, automotive, and medical engineering. Magnetic abrasive finishing is a finishing process, in which a magnetic field is applied on a mixture of abrasive and ferromagnetic particles to form a flexible magnetic abrasive brush that may then be utilized for polishing a workpiece.

In a magnetic abrasive finishing process, control over the force exerted by a flexible magnetic abrasive brush on an outer surface of a workpiece is essential for achieving a uniformly finished surface, especially in case of curved surfaces with complex geometries. One way to control the force exerted by magnetic abrasive particles on an outer surface of a workpiece is to maintain a perpendicular distance between a center of the magnetic field and the outer surface of the workpiece constant as the flexible magnetic brush moves along the curved surface by moving the flexible magnetic brush relative to the outer surface. To this end, an extra actuating mechanism may be needed for actuating a translational movement of the flexible magnetic brush relative to the outer surface of the workpiece to maintain the perpendicular distance constant, which may lead to an unwanted complexity of the finishing apparatus.

There is a need for a magnetic abrasive finishing apparatus that may precisely monitor and control the force exerted by magnetic abrasive particles on an outer curved surface of a workpiece to ensure that the curved surface of the workpiece is polished with uniform surface quality without a need for extra movements of either the magnetic abrasive brush or the workpiece.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to a system for magnetic abrasive finishing of a workpiece. The exemplary system may include a magnetic abrasive brush that may include a plurality of magnetic/abrasive particles and an electromagnet configured to apply a magnetic field on the plurality of magnetic abrasive particles. The exemplary system may further include a first actuating mechanism that may be configured to actuate a rotational movement of the workpiece about a longitudinal axis of the workpiece, a second actuating mechanism that may be configured to actuate a linear movement of the magnetic abrasive brush relative to the workpiece along the longitudinal axis of the workpiece, a sensor coupled to the magnetic abrasive brush that may be configured to measure a working gap between the magnetic abrasive brush and an outer surface of the workpiece at any given instant. The working gap may be a distance between a center of the magnetic field and the outer surface of the workpiece along a first axis perpendicular to the longitudinal axis of the workpiece. The exemplary system may further include a control unit that may be coupled to the sensor and magnetic abrasive brush and may be configured to adjust a magnetic flux density of the magnetic field based on the measured working gap at any given instant.

In an exemplary embodiment, the control unit may include a processor, and a memory coupled to the processor that may be configured to store executable instructions to cause the processor to receive a set point for the magnetic flux density, receive the working gap at a given instant, and calculate an amount of electric current that, when flowing through the electromagnet, generates an adjusted magnetic flux density at the received working gap at the given instant, the adjusted magnetic flux density equal to the set point.

In an exemplary embodiment, the memory may further be configured to store executable instructions to cause the processor to apply a voltage to the electromagnet causing the calculated amount of electric current to flow through the electromagnet.

In an exemplary embodiment, the electromagnet may include a magnetic core, and a magnetic coil wound around the magnetic core. The magnetic coil may be coupled to an electric power source via a variable transformer.

In an exemplary embodiment, the control unit may further be coupled with the variable transformer and configured to adjust the magnetic flux density of the magnetic field based on the measured working gap at any given instant by adjusting an output voltage of the variable transformer based on the measured working gap at any given instant.

In an exemplary embodiment, the sensor may include a linear variable differential transformer (LVDT) that may include a ferromagnetic coil, a sensor rod coupled to the ferromagnetic core from a first end, and a sensor tip coupled with the sensor rod from a second opposing end. The sensor tip may be movable on the outer surface of the workpiece. The exemplary LVDT may be configured to measure a distance between the sensor tip and a reference point.

In an exemplary embodiment, the workpiece may be axially symmetric about the longitudinal axis of the workpiece. A perpendicular distance between the reference point and the longitudinal axis of the workpiece may be equal to a perpendicular distance between the center of the magnetic field generated in the electromagnet and the longitudinal axis of the workpiece.

In an exemplary embodiment, the sensor may be mounted in line with the abrasive magnetic brush along the first axis at an opposite side of the workpiece. In an exemplary embodiment, the workpiece may be axially symmetric about the longitudinal axis of the workpiece, and the longitudinal axis may be a main axis of the workpiece.

According to one or more exemplary embodiments, the present disclosure is directed to a method for magnetic abrasive finishing of a workpiece. The exemplary method may include sweeping an outer surface of the workpiece by a magnetic abrasive brush. The exemplary magnetic abrasive brush may include a plurality of magnetic abrasive particles and an electromagnet that may be configured to apply a magnetic field on the plurality of magnetic abrasive particles. Sweeping the entire area of the outer surface of the workpiece may include actuating a rotational movement of the workpiece relative to the magnetic abrasive brush about a longitudinal axis of the workpiece and actuating a linear translational movement of the magnetic abrasive brush relative to the workpiece along a first axis parallel with the longitudinal axis of the workpiece.

According to an exemplary embodiment, the exemplary method may further include measuring a working gap between the outer surface of the workpiece and the magnetic abrasive brush. The working gap may be a distance between the outer surface of the workpiece and a center of the magnetic field generated in the electromagnet along a second axis perpendicular to the longitudinal axis of the workpiece. Measuring the working gap may include associating a linear displacement sensor with the workpiece. The exemplary method may further include adjusting a magnetic flux density of the magnetic field based on the measured working gap between the outer surface of the workpiece and the magnetic abrasive brush.

In an exemplary embodiment, adjusting the magnetic flux density of the magnetic field based on the measured working gap may include receiving a set point for the magnetic flux density and generating the magnetic field with a magnetic flux density equal to the set point at a distance from the magnetic abrasive brush along the second axis, where the distance may be equal to the measured working gap.

In an exemplary embodiment, generating the magnetic field may include calculating an amount of electric current that, when flowing through the electromagnet, generates a magnetic flux density equal to the set point at the measured working gap and applying a voltage to the electromagnet causing the calculated amount of current to flow through the electromagnet.

In an exemplary embodiment, associating the linear displacement sensor with the workpiece may include associating the linear displacement sensor with an axially symmetric workpiece. The exemplary linear displacement sensor may include a linear variable differential transformer (LVDT) comprising a ferromagnetic coil, a sensor rod coupled to the ferromagnetic core from a first end, and a sensor tip coupled with the sensor rod from a second opposing end, the sensor tip movable on the outer surface of the workpiece. The exemplary LVDT may be configured to measure a distance between the sensor tip and a reference point. Associating the linear displacement sensor with an axially symmetric workpiece may include mounting the linear displacement sensor adjacent the workpiece such that a perpendicular distance between the reference point and the longitudinal axis of the workpiece is equal to a perpendicular distance between the center of the magnetic field generated in the electromagnet and the longitudinal axis of the workpiece.

In an exemplary embodiment, associating the linear displacement sensor with an axially symmetric workpiece may further include mounting the linear displacement sensor in line with the abrasive magnetic brush along the first axis at an opposing side of the workpiece.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
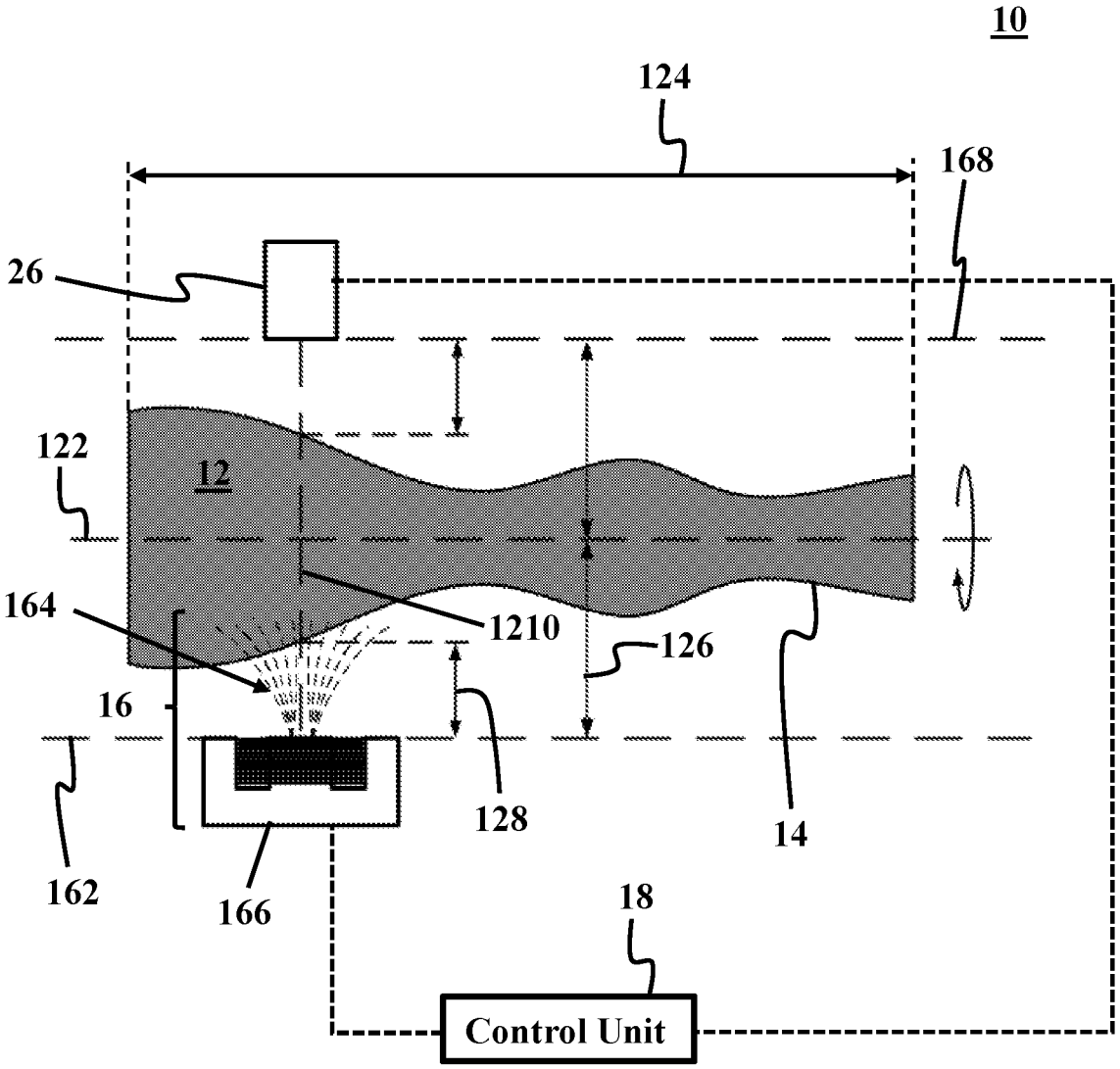
FIG. 1 illustrates a schematic of a magnetic abrasive finishing (MAF) system, consistent with one or more exemplary embodiments of the present disclosure.

In the following detailed description, numerous specific details are set forth by way of examples to provide a thorough understanding of the relevant teachings related to the exemplary embodiments. However, it should be apparent that the present teachings may be practiced without such details. In other instances, well-known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown but is to be accorded the widest possible scope consistent with the principles and features disclosed herein.

The present disclosure is directed to an exemplary system and an exemplary method for magnetic abrasive finishing (MAF) of a curved outer surface of a workpiece. In an exemplary embodiment, an exemplary workpiece may be rotated about a longitudinal axis of the workpiece while a flexible magnetic abrasive (MA) brush may move along the longitudinal axis of the workpiece contacting and thereby polishing the outer surface of the workpiece.

An exemplary flexible MA brush may be formed by applying a magnetic field on a mixture of magnetic particles and abrasive particles, referred to hereinafter as magnetic/abrasive particles. Under the influence of the applied magnetic field, the magnetic/abrasive particles may form magnetic chains along magnetic field lines of the applied magnetic field and the magnetic/abrasive particles may appear and behave similarly to a wire polishing brush. The magnetic chains of particles may be flexible and may conform around the outer surface of the workpiece, hence the magnetic brush formed by these magnetic chains of magnetic/abrasive particles may be referred to as a flexible MA brush. An exemplary flexible MA brush may impart machining forces on the outer surface of the workpiece as the magnetic/abrasive particles within the flexible MA brush impact the outer surface of the workpiece.

In case of curved surfaces, as an exemplary flexible MA brush moves along a longitudinal axis of an exemplary workpiece, a working gap between the flexible MA brush and the outer surface of the workpiece may change due to the curvatures of the outer surface. Changes in the working gap during the finishing process may lead to fluctuations in the finishing forces exerted by the flexible MA brush on the outer surface of the workpiece. Under a constant magnetic field, as the working gap increases, the finishing force exerted by the flexible MA brush may decrease and as the working gap decreases the finishing force exerted by the flexible MA brush may increase which may lead to an uneven finished surface. As used herein, a working gap between the flexible MA brush and the outer surface of the workpiece may refer to a distance between a center of the applied magnetic field and an outer surface of the workpiece along an axis perpendicular to a longitudinal axis of the workpiece.

An exemplary system for magnetic abrasive finishing of the workpiece may include a sensor that may be coupled to the exemplary flexible MA brush and may be moveable with the exemplary flexible MA brush along the longitudinal axis of the workpiece. An exemplary sensor may be utilized for measuring a working gap between a flexible MA brush and an outer surface of the workpiece at any given instant during a magnetic abrasive finishing process. An exemplary system for magnetic abrasive finishing of the workpiece may further include a control unit that may be configured to maintain the finishing forces exerted by an exemplary flexible MA brush on an outer surface of a workpiece constant by manipulating an intensity of the magnetic field applied to the flexible MA brush according to changes in the working gap. In an exemplary embodiment, as the working gap changes, the exemplary control unit may change the intensity of the applied magnetic field accordingly. For example, as the working gap increases, the exemplary control unit may increase the intensity of the magnetic field and as the working gap decreases, the exemplary control unit may decrease the intensity of the applied magnetic field to maintain a constant finishing force along the entire curved surface of the workpiece.

In an exemplary embodiment, adjusting intensity of the magnetic field applied to magnetic/abrasive particles according to changes in the working gap between the flexible MA brush and the outer surface of the workpiece during the magnetic abrasive finishing may allow the exemplary systems and methods to perform a uniform finishing of an outer surface of an exemplary workpiece without a need for adjusting the working gap between the flexible MA brush and the outer surface of the workpiece by moving either the flexible MA brush or the workpiece relative to each other utilizing an extra actuating mechanism.

Furthermore, adjusting the intensity of the magnetic field according to the changes in the working gap may allow for a more precise control over the finishing forces exerted on the outer surface of the workpiece in comparison with adjusting the working gap at every instant of the finishing process because fine-tuning the intensity of the magnetic field may be relatively easier than fine-tuning the working gap, especially for workpieces with very complex curved surfaces.

FIG. 1 illustrates a schematic of a MAF system 10, consistent with one or more exemplary embodiments of the present disclosure. In an exemplary embodiment, MAF system 10 may be utilized for magnetic abrasive finishing of a workpiece 12 with a curved outer surface 14. In an exemplary embodiment, curved outer surface 14 may be one of a surface of revolution, a quadratic surface, a ruled surface, and a surface of constant curvature with a constant Gaussian curvature. In an exemplary embodiment, MAF system 10 may include a flexible MA brush 16 that may be placed adjacent and in contact with curved outer surface 14 of workpiece 12. In an exemplary embodiment, workpiece 12 may be rotated about a longitudinal axis 122 of workpiece 12 and flexible MA brush 16 may be moveable on an axis 162 parallel with longitudinal axis 122 along a length 124 of workpiece 12. In exemplary embodiments, rotational movement of workpiece 12 about longitudinal axis 122 and linear movement of flexible MA brush 16 along axis 162 may allow for flexible MA brush 16 to sweep curved outer surface 14 of workpiece 12. In an exemplary embodiment, longitudinal axis 122 may be a main axis of workpiece 12, around which workpiece 12 is axially symmetric.

In an exemplary embodiment, flexible MA brush 16 may include magnetic/abrasive particles 164 that may be a mixture of magnetic particles such as iron particles and abrasive particles such as silicon carbide particles. In an exemplary embodiment, flexible MA brush 16 may further include an electromagnet 166 that may or may be configured to apply a magnetic field on magnetic/abrasive particles 164 to arrange magnetic/abrasive particles 164 along magnetic field lines of the applied magnetic field. In an exemplary embodiment, magnetic/abrasive particles 164 may impact and exert a machining force on curved outer surface 14 of workpiece 12 as workpiece 12 rotates about longitudinal axis 122 and flexible MA brush 16 moves along length 124 of workpiece 12. In other words, the entire area of curved outer surface 14 of workpiece 12 may be swept by flexible MA brush 16 by rotating workpiece 12 about longitudinal axis 122 and concurrently moving flexible MA brush 16 along length 124 of workpiece 12. As used herein, machining force may refer to the force exerted by magnetic/abrasive particles 164 upon impact on curved outer surface 14 that may remove excess material from curved outer surface 14 to achieve a smooth and polished surface.

In an exemplary embodiment, flexible MA brush 16 may be positioned adjacent to rotatable workpiece 12 at a perpendicular distance 126 from longitudinal axis 122 of workpiece 12 such that a working gap 128 may exist between electromagnet 166 and curved outer surface 14. As used herein, positioning flexible MA brush 16 adjacent to workpiece 12 may refer to positioning flexible MA brush 16 at perpendicular distance 126 from longitudinal axis 122 of workpiece 12 such that magnetic/abrasive particles 164 or a portion of magnetic/abrasive particles 164, when formed as a brush, may contact curved outer surface 14 of workpiece 12.

In an exemplary embodiment, working gap 128 may be a distance between electromagnet 166 and curved outer surface 14 along an axis 1210 perpendicular to longitudinal axis 122 of workpiece 12. For an exemplary workpiece with a curved outer surface, such as workpiece 12, as flexible MA brush 16 moves along length 124 of workpiece 12, working gap 128 may change due to curvatures of curved outer surface 14.

The magnetic field generated by electromagnet 166, if generated with a constant intensity, may exert a lower magnetic force on a portion of magnetic/abrasive particles 164 that may be farther away from a center of the magnetic field generated in electromagnet 166, accordingly, when working gap 128 increases due to curvatures of curved outer surface 14, a lower machining force may be exerted by the portion of magnetic/abrasive particles 164 that may impact curved outer surface 14.

In an exemplary embodiment, MAF system 10 may further include a control unit 18 that may be configured to adjust an intensity of the magnetic field applied by electromagnet 166 according to changes in working gap 128. For example, when working gap 128 increases, control unit 18 may be configured to increase the intensity of the magnetic field applied by electromagnet 166 and when working gap 128 decreases, control unit 18 may be configured to decrease the intensity of the magnetic field applied by electromagnet 166. In exemplary embodiments, utilizing control unit 18 for changing the intensity of the applied magnetic field by electromagnet 166 according to changes of working gap 128 may allow MAF system 10 to exert a uniform machining force on curved outer surface 14 of workpiece 12.

Figure 2:
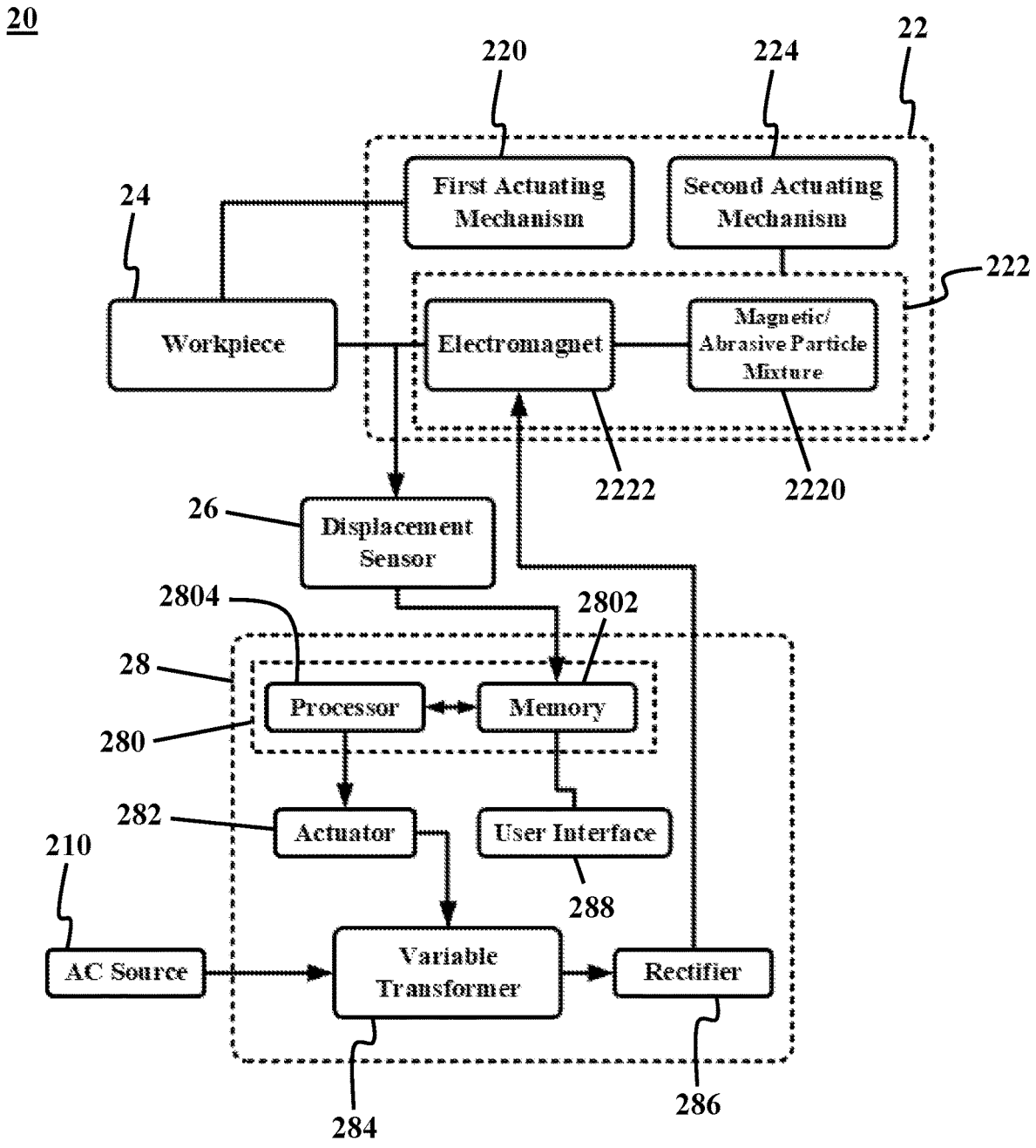
FIG. 2 illustrates a functional block diagram of a MAF system, consistent with one or more exemplary embodiments of the present disclosure.

FIG. 2 illustrates a functional block diagram of a MAF system 20, consistent with one or more exemplary embodiments of the present disclosure. In an exemplary embodiment, MAF system 20 may be similar to MAF system 10.

In an exemplary embodiment, MAF system 20 may include a MAF apparatus 22 that may be utilized to perform a magnetic abrasive finishing process on a workpiece 24 similar to workpiece 12. In an exemplary embodiment, MAF apparatus 22 may include a first actuating mechanism 220 that may be coupled to workpiece 24 and may be configured to drive a rotational movement of workpiece 24 about a longitudinal axis of workpiece 24 similar to what was described in connection with workpiece 12 of FIG. 1.

In an exemplary embodiment, MAF apparatus 22 may further include an MA brush 222 that may be similar to flexible MA brush 16. In an exemplary embodiment, MA brush 222 may include magnetic/abrasive particles 2220 similar to magnetic/abrasive particles 164 that may include a mixture of magnetic particles and abrasive particles. In an exemplary embodiment, MA brush 222 may further include an electromagnet 2222 similar to electromagnet 166 that may be configured to apply a magnetic field on magnetic/abrasive particles 2220 to arrange magnetic/abrasive particles 2220 along magnetic field lines of the applied magnetic field.

In an exemplary embodiment, MAF apparatus 22 may further include a second actuating mechanism 224 that may be coupled to MA brush 222 and may be configured to drive a translational movement of MA brush 222 parallel to a longitudinal axis of workpiece 24 similar to what was described in connection with electromagnet 166 of FIG. 1.

In an exemplary embodiment, MAF system 20 may further include a displacement sensor 26 that may be coupled to MAF apparatus 22 and may be configured to measure changes in working gap between electromagnet 2222 and an outer surface of workpiece 24. Referring to FIG. 1, in an exemplary embodiment, workpiece 12 may be a workpiece with axial symmetry around longitudinal axis 122. Displacement sensor 26 may be positioned on an opposing side of workpiece 12 with respect to electromagnet 166 along axis 1210 and displacement sensor 26 may be moveable with electromagnet 166 along an axis 168 parallel to longitudinal axis 122. In an exemplary embodiment, displacement sensor 26 may be configured to measure a distance 260 between a reference point 262 and curved outer surface 14 of workpiece 12. Reference point 262 may be selected such that a perpendicular distance 264 between reference point 262 and longitudinal axis 122 of workpiece 12 may be equal to perpendicular distance 126 between electromagnet 166 and longitudinal axis 122 of workpiece 12 and since workpiece 12 is axially symmetric around longitudinal axis 122, distance 260 measured by displacement sensor 26 may be equal to working gap 128. Such arrangement of displacement sensor 26 and electromagnet 166 with respect to axially symmetric workpiece 12 may allow displacement sensor 26 to measure changes in working gap 128 as flexible MA brush 16 and displacement sensor 26 move along workpiece 12 parallel to longitudinal axis 122.

In an exemplary embodiment, MAF system 20 may further include a control unit 28 that may be similar to control unit 18. In an exemplary embodiment, control unit 28 may be coupled in data communication with displacement sensor 26 and may be configured to receive the measured changes in working gap 128 and to adjust an intensity of the magnetic field applied by electromagnet 2222 according to changes in working gap 128.

In an exemplary embodiment, control unit 28 may include a programmable logic controller (PLC) 280, an actuator 282, a variable transformer 284, and a rectifier 286. In an exemplary embodiment, PLC 280 may include a memory 2802 and a processor 2804. Memory 2802 may include executable instructions that, when executed, cause processor 2804 to perform operations that in an exemplary embodiment may include receiving a set point for the magnetic flux density, receiving a measured value for working gap 128 at a given instant, and calculating an amount of electric current flowing through electromagnet 2222 that may generate a magnetic flux density equal to the set point at a distance from electromagnet 2222 equal to working gap 128 at the given instant.

In an exemplary embodiment, variable transformer 284 may be coupled with actuator 282 and actuator 282 may be functionally coupled with processor 2804. Memory 2802 may further include instructions, that, when executed, cause processor 2804 to control an output voltage of variable transformer 284 by actuating variable transformer 284 utilizing actuator 282. In an exemplary embodiment, electromagnet 2222 may be connected to an AC power source 210 via variable transformer 284. Processor 2804 may control the output voltage of variable transformer 284 such that the electric current passing through electromagnet 2222 may be equal to the calculated amount of electric current by processor 2804 based on the measured value for working gap 128 at any given instant. In exemplary embodiments, such configuration of PLC 280 and variable transformer 284 may allow control unit 28 to manipulate an amount of electric current passing through electromagnet 2222 such that a magnetic field may be generated by electromagnet 2222 with a magnetic flux density equal to the set point at a distance from electromagnet 2222 equal to working gap 128 at a given instant during magnetic abrasive finishing process. In an exemplary embodiment, rectifier 286 may optionally be utilized for receiving the alternating output of variable transformer 284 and convert the alternating current into a direct current.

In an exemplary embodiment, memory may further be configured to store executable instructions that, when executed, cause processor to calculate an amount of electric current flowing through electromagnet 2222 that may generate a magnetic flux density equal to the set point at a distance from electromagnet 2222 equal to working gap 128 by operations defined by Equation (1) below:

$$I = \frac{2B(R^2 + x^2)^{3/2}}{\mu_0 R^2} \quad \text{Equation (1)}$$

In Equation (1) above, $\mu_0$ is a vacuum permeability constant equal to $1.2566370614\times10^{-6}$ N/A$^2$, I is an amount of electric current, B is a set point for magnetic flux density, R is a coil radius of the electromagnet, and x is working gap 128. As mentioned before, working gap 128 may be a distance between electromagnet 166 and curved outer surface 14 along an axis 1210 perpendicular to longitudinal axis 122 of workpiece 12. As used herein a distance between electromagnet 166 and curved outer surface 14 may refer to a distance between a center of magnetic field generated by electromagnet 166 and curved outer surface 14. In an exemplary embodiment, the set point for magnetic flux density B may be at least 0.8 mT. As used herein, the center of magnetic field generated by electromagnet 166 may refer to a center of the coil of electromagnet 166, as will be described.

In an exemplary embodiment, control unit 28 may further include a user interface unit 288 that may include a graphical user interface unit (GUI) that may be optionally configured to receive data input from a user. In an exemplary embodiment, data input by the user may include a set point for the magnetic flux density. In an exemplary embodiment, the set point for magnetic flux density B may be at least 0.8 mT. In an exemplary embodiment, PLC 280 may be connected in data communication with user interface unit 288 and may be configured to receive the set point from user interface unit 288.

Figure 3A:
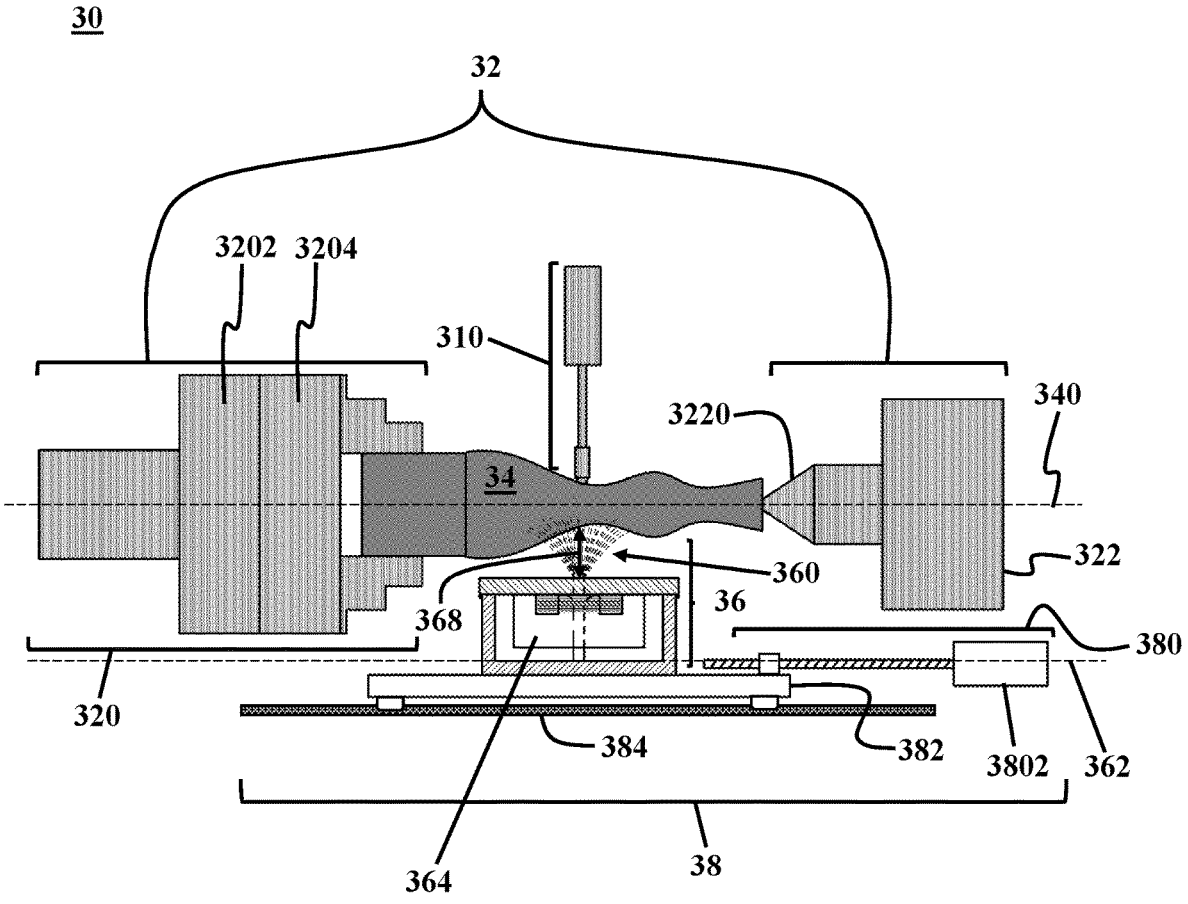
FIG. 3A illustrates a MAF apparatus, consistent with one or more exemplary embodiments of the present disclosure.

FIG. 3A illustrates a MAF apparatus 30, consistent with one or more exemplary embodiments of the present disclosure. In an exemplary embodiment, MAF apparatus 300 may be similar to MAF apparatus 22.

In an exemplary embodiment, MAF apparatus 30 may include a first actuating mechanism 32 similar to first actuating mechanism 220 that may be coupled with a workpiece 34 similar to workpiece 24. First actuating mechanism 32 may be configured to actuate a rotational movement of workpiece 34 about a longitudinal axis 340 of workpiece 34. In an exemplary embodiment, first actuating mechanism 32 may include a headstock 320 including a spindle 3202 that may be powered by a rotary actuator. Workpiece 34 may be coupled with spindle 3202 utilizing a chuck 3204 and spindle 3202 may impart a rotational movement to workpiece 34 about longitudinal axis 340. In an exemplary embodiment, first actuating mechanism 32 may further include a tailstock 322 counterpoint to headstock 320. Tailstock 322 may include a hardened steel center 3220 that may be positioned directly in line with spindle 3202 and may be utilized to support workpiece 34 as it rotates about longitudinal axis 340.

In an exemplary embodiment, MAF apparatus 30 may further include a flexible MA brush 36 similar to MA brush 222 that may be positioned adjacent to workpiece 34 and may be moveable along an axis 362 parallel to longitudinal axis 340. In an exemplary embodiment, flexible MA brush 36 may be positioned adjacent to workpiece 34 such that magnetic/abrasive particles 360 of flexible MA brush 36 may impact an outer surface of workpiece 34 as it rotates about longitudinal axis 340. In an exemplary embodiment, flexible MA brush 36 may be movable along axis 362 such that magnetic/abrasive particles 360 of flexible MA brush 36 may impact outer surface of workpiece 34 along an entire length of workpiece 34.

Figure 3B:
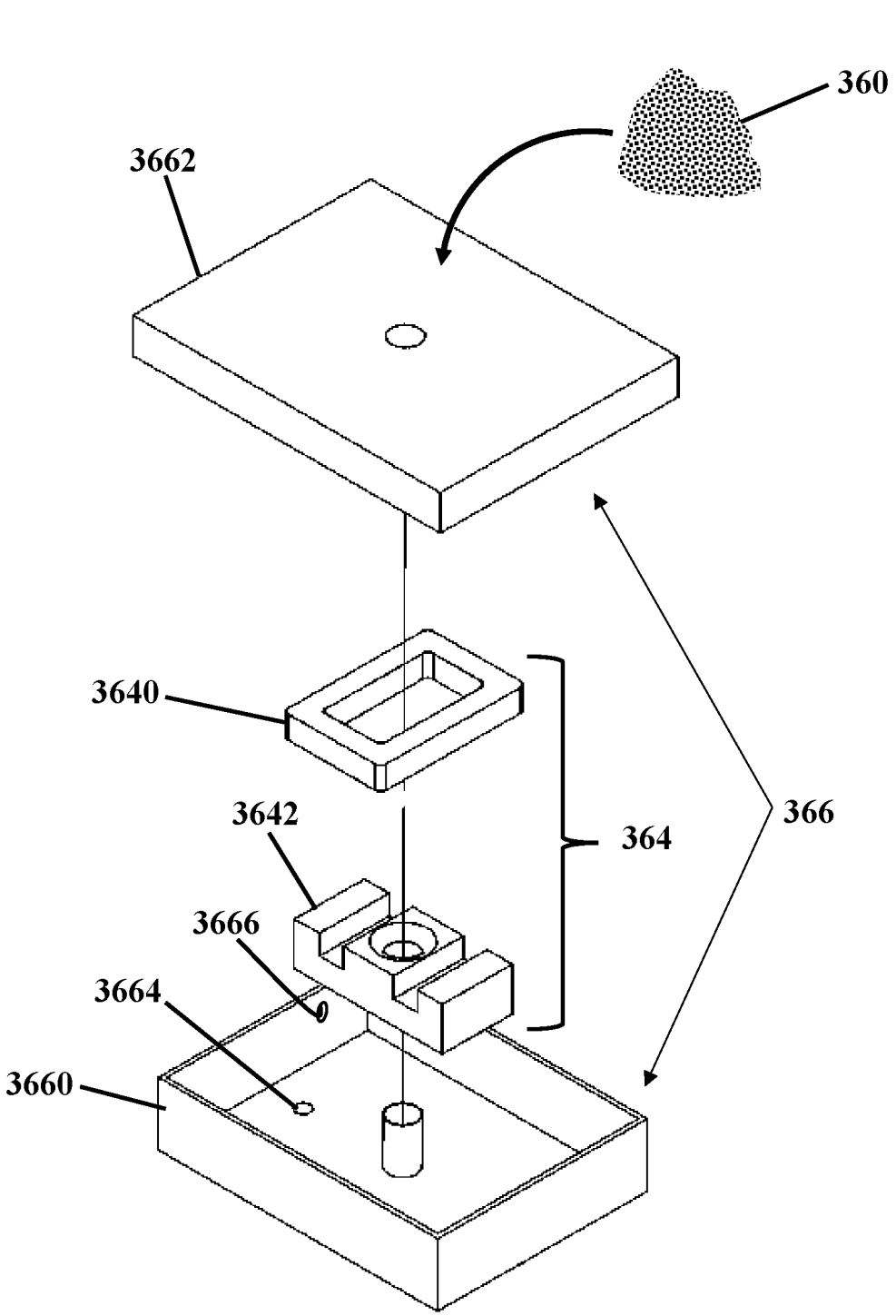
FIG. 3B illustrates an exploded view of a flexible magnetic abrasive (MA) brush, consistent with one or more exemplary embodiments of the present disclosure.

FIG. 3B illustrates an exploded view of flexible MA brush 36, consistent with one or more exemplary embodiments of the present disclosure. In an exemplary embodiment, flexible MA brush 36 may include an electromagnet 364, which may include a magnetic coil 3640 that may be wound around a magnetic core 3642. In an exemplary embodiment, electromagnet 364 may be similar to electromagnet 2222 and may be connected to a power source similar to AC power source 210 via a variable transformer similar to variable transformer 284, the output current of which may be controlled by a control unit (not illustrated) similar to control unit 28. In an exemplary embodiment, the electric current provided via variable transformer 284 may pass through magnetic coil 3640 and a magnetic field may be generated in electromagnet 364, the magnetic flux density of which may be adjusted by manipulating the electric current passing through magnetic coil 3640 by control unit 28 as was described in preceding paragraphs.

In an exemplary embodiment, flexible MA brush 36 may include a housing 366 that may include compartment 3660 and a cover 3662. Since generating a magnetic field in electromagnet 364 may create a considerable amount of heat, electromagnet 364 may be disposed within compartment 3660 in which a coolant material may flow. In an exemplary embodiment, compartment 3660 may include a coolant inlet port 3664 and a coolant outlet port 3666 which may be connected in fluid communication with a coolant circulation system. The flow of coolant in and out of compartment 3660 via inlet port 3664 and outlet port 3666 may expose electromagnet 364 to the coolant material and may remove excess heat from electromagnet 364. In an exemplary embodiment, magnetic/abrasive particles 360 may be poured over cover 3662 and may be rearranged along magnetic field lines of the magnetic field generated by electromagnet 364. Under the influence of the magnetic field generated in electromagnet 364, magnetic/abrasive particles 360 may appear and behave similarly to a wire polishing brush.

In an exemplary embodiment, MAF apparatus 30 may further include a second actuating mechanism 38 similar to second actuating mechanism 224 that may be coupled with flexible MA brush 36 and may be configured to actuate a translational movement of flexible MA brush 36 along axis 362 parallel with longitudinal axis 340 of workpiece 34. In an exemplary embodiment, second actuating mechanism 38 may include a linear actuator 380 that may be coupled to a sliding plate 382. Flexible MA brush 36 may be mounted on sliding plate 382 and linear actuator 380 may actuate a translational movement of sliding plate 382 along axis 362 over a sliding rail 384. In an exemplary embodiment, linear actuator 380 may be a mechanical linear actuator that may convert a rotary motion of a motor 3802 into a linear motion of sliding plate 382. Examples of mechanical linear actuators that may be utilized may include but are not limited to screw actuators such as leadscrew, screw jack, ball screw, and roller screw actuators.

In an exemplary embodiment, MAF apparatus 30 may further include a displacement sensor 310 that may be similar to displacement sensor 26 and may be configured to measure changes in working gap 368 between flexible MA brush 36 and the outer surface of workpiece 34 along the length of workpiece 34.

Figure 3C:
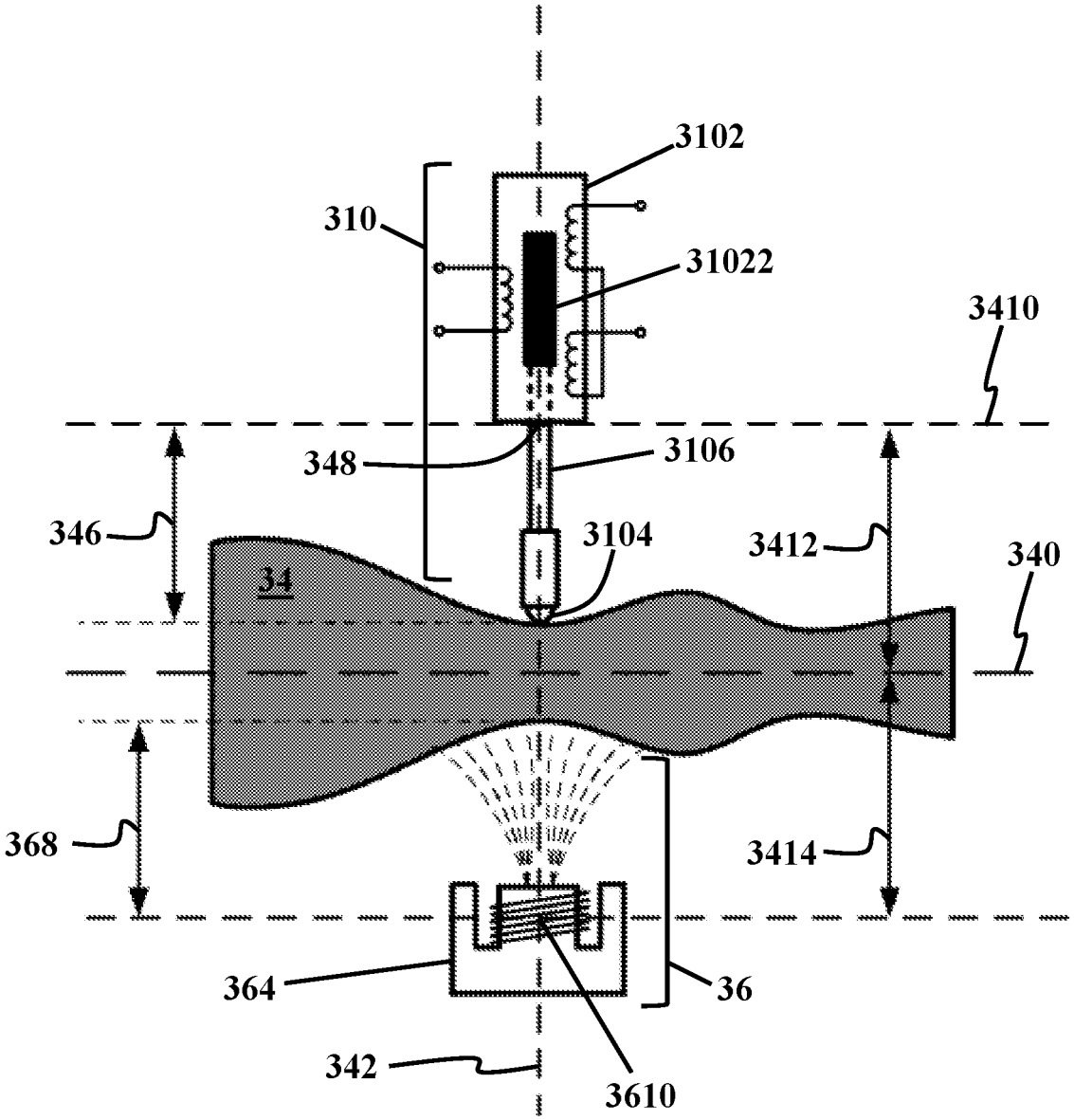
FIG. 3C illustrates a schematic side-view of a displacement sensor, a flexible MA brush positioned adjacent an axially symmetric workpiece, consistent with one or more exemplary embodiments of the present disclosure.

FIG. 3C illustrates a schematic side-view of displacement sensor 310, flexible MA brush 36 positioned adjacent an axially symmetric workpiece 34, consistent with one or more exemplary embodiments of the present disclosure. In an exemplary embodiment, displacement sensor 310 may include an electrical transformer, such as a linear variable differential transformer (LVDT) 3102 and a sensor tip 3104 that may be coupled with a ferromagnetic core 31022 of LVDT 3102 by a spring-loaded sensor rod 3106. In an exemplary embodiment, sensor tip 3104 may be a spherical roller that may be coupled to an opposite end of sensor rod 3106 with respect to LVDT 3102 and it may freely roll on the outer surface of workpiece 34 while spring-loaded sensor rod 3106 may maintain contact of roller 3104 with the outer surface of workpiece 34. In an exemplary embodiment, LVDT 3102 may be configured to measure displacement of sensor tip 3104 with respect to a reference point 348 and since sensor tip 3104 may roll over the outer surface of workpiece 34, the measured distance of sensor tip 3104 with respect to reference point 348 is equal to a distance 346 between reference point 348 and outer surface of workpiece 34.

In an exemplary embodiment, workpiece 34 may be a workpiece with axial symmetry around longitudinal axis 340. Displacement sensor 310 may be positioned on an opposing side of workpiece 34 with respect to flexible MA brush 36 along an axis 342 perpendicular to longitudinal axis 340 and displacement sensor 310 may be moveable with flexible MA brush 36 along an axis parallel to longitudinal axis 340. In an exemplary embodiment, displacement sensor 310 may be configured to measure distance 346 between reference point 348 and curved outer surface of workpiece 34. Reference point 348 may be moveable on a reference line 3410 parallel with longitudinal axis 340 with a perpendicular distance 3412 between reference line 3410 and longitudinal axis 340 of workpiece 34 equal to perpendicular distance 3414 between flexible MA brush 36 and longitudinal axis 340 of workpiece 34 and since workpiece 34 is axially symmetric around longitudinal axis 340, distance 346 measured by displacement sensor 310 is equal to working gap 368 between flexible MA brush 36 and outer surface of workpiece 34. As used herein, perpendicular distance 3414 between flexible MA brush 36 and longitudinal axis 340 of workpiece 34 at any point along the length of workpiece 34 may refer to a distance between a center 3610 of magnetic field generated in electromagnet 364 of flexible MA brush 36 and longitudinal axis 340. In an exemplary embodiment, Displacement sensor 310 may be mounted on sliding plate 382 so that displacement sensor may be movable with flexible MA brush 36 while being in line with flexible MA brush 36 along axis 342 at every instant during the magnetic abrasive finishing process.

In exemplary embodiments, such arrangement of displacement sensor 310 and flexible MA brush 36 with respect to axially symmetric workpiece 34 may allow displacement sensor 310 to measure changes in working gap 3414 as flexible MA brush 36 and displacement sensor 310 move along workpiece 34 parallel to longitudinal axis 340.

Figure 4:
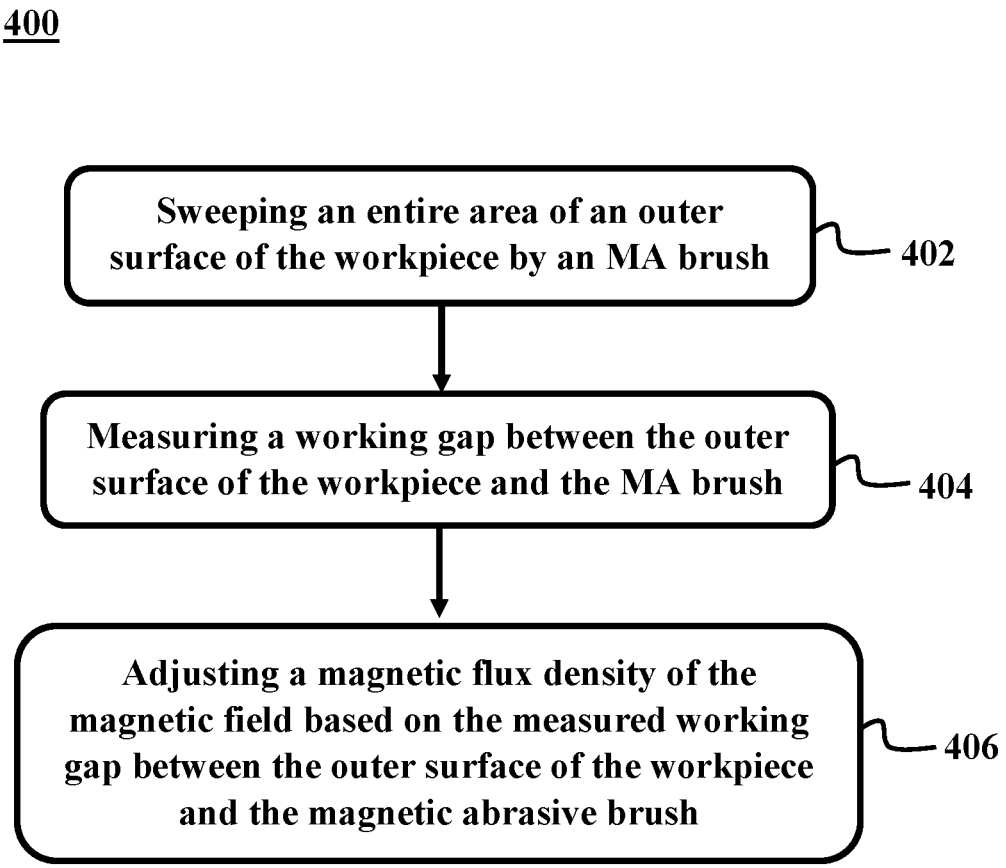
FIG. 4 illustrates a method for magnetic abrasive finishing of a workpiece, consistent with one or more exemplary embodiments of the present disclosure.

FIG. 4 illustrates a method 400 for magnetic abrasive finishing of a workpiece, consistent with one or more exemplary embodiments of the present disclosure. In an exemplary embodiment, method 400 may be implemented by MAF system 20.

In an exemplary embodiment, method 400 may include a step 402 of sweeping an outer surface of the workpiece by an MA brush, where the MA brush may include a plurality of magnetic abrasive particles and an electromagnet that may apply a magnetic field on the plurality of magnetic abrasive particles, a step 404 of measuring a working gap between the outer surface of the workpiece and the MA brush, and a step 406 of adjusting a magnetic flux density of the magnetic field based on the measured working gap between the outer surface of the workpiece and the magnetic abrasive brush.

In an exemplary embodiment, step 402 of sweeping an outer surface of the workpiece by an MA brush may include actuating a rotational movement of the workpiece relative to the MA brush about a longitudinal axis of the workpiece. In an exemplary embodiment, actuating the rotational movement of the workpiece relative to the MA brush about the longitudinal axis of the workpiece may involve coupling the workpiece with a first actuating mechanism, where the first actuating mechanism may be configured to drive a rotational movement of the workpiece about the longitudinal axis of the workpiece. For example, first actuating mechanism 32 may be coupled with workpiece 34 and may be configured to actuate a rotational movement of workpiece 34 about longitudinal axis 340 of workpiece 34.

In an exemplary embodiment, step 402 of sweeping an outer surface of the workpiece by an MA brush may further include actuating a linear translational movement of the MA brush relative to the workpiece along a first axis parallel with the longitudinal axis of the workpiece. In an exemplary embodiment, actuating the linear translational movement of the MA brush relative to the workpiece along the first axis may involve coupling the MA brush with a second actuating mechanism, where the second actuating mechanism may be configured to drive a translational movement of the MA brush along the axis parallel with the longitudinal axis of the workpiece. For example, second actuating mechanism 38 may be coupled with flexible MA brush 36 and may be configured to actuate a translational movement of flexible MA brush 36 along axis 362 parallel with longitudinal axis 340 of workpiece 34.

In an exemplary embodiment, step 404 of measuring a working gap between the outer surface of the workpiece and the MA brush may involve continuously measuring the working gap at every point along the axis parallel with the longitudinal axis of the workpiece. In an exemplary embodiment, the working gap may be a distance between the outer surface of the workpiece and a center of the magnetic field generated in the electromagnet along a second axis perpendicular to the longitudinal axis of the workpiece. For example, working gap 368 between outer surface of the workpiece 34 and the MA brush 36 may be a distance between center 3610 of the magnetic field generated in electromagnet 364 and the outer surface of workpiece 34 along axis 342. In an exemplary embodiment, center 3610 of the magnetic field generated in electromagnet 364 may move parallel with longitudinal axis 340 of workpiece 34 due to the linear translational movement of MA brush 36 along axis 362 parallel with longitudinal axis 340 of workpiece 34 and working gap 368 may be continuously measured along the length of workpiece 34 at every point during the application of magnetic field on workpiece 34.

In an exemplary embodiment, measuring the working gap at every point along the axis parallel with the longitudinal axis of the workpiece may involve associating a linear displacement sensor with the workpiece. For example, displacement sensor 310 may be coupled with workpiece 34 and may be configured to measure changes in working gap 368 between flexible MA brush 36 and the outer surface of workpiece 34 along the length of workpiece 34 as flexible MA brush 36 is moved along axis 362 parallel with longitudinal axis 340 of workpiece 34.

In an exemplary embodiment, associating the linear displacement sensor with the workpiece comprises associating the linear displacement sensor with an axially symmetric workpiece that may involve mounting the linear displacement sensor adjacent to the workpiece such that a perpendicular distance between the reference point and the longitudinal axis of the workpiece is equal to a perpendicular distance between the center of the magnetic field generated in the electromagnet and the longitudinal axis of the workpiece. For example, linear displacement sensor 310 may be mounted adjacent to workpiece 34 such that perpendicular distance 3412 between 348 and longitudinal axis 340 may be equal to perpendicular distance 3414 between center 3610 of the magnetic field generated in electromagnet 364 and longitudinal axis 340. As used herein, in an exemplary embodiment, center 3610 of the magnetic field generated in electromagnet 364 may be a center of magnetic core 3642.

In an exemplary embodiment, associating the linear displacement sensor with an axially symmetric workpiece may further involve mounting the linear displacement sensor in line with the MA brush along the first axis at an opposing side of the workpiece. For example, linear displacement sensor 310 may be mounted in line with MA brush 36 along axis 342.

In an exemplary embodiment, step 406 of adjusting a magnetic flux density of the magnetic field based on the measured working gap between the outer surface of the workpiece and the magnetic abrasive brush may involve receiving a set point for the magnetic flux density, and generating the magnetic field with a magnetic flux density equal to the set point at a distance from the magnetic abrasive brush along the second axis, the distance equal to the measured working gap.

In an exemplary embodiment, generating the magnetic field may include calculating an amount of electric current that, when flowing through the electromagnet, generates a magnetic flux density equal to the set point at the measured working gap. In an exemplary embodiment, calculating the amount of electric current comprises operations defined by Equation (1). For example, memory 2802 may include executable instructions that, when executed, cause processor 2804 to calculate an amount of electric current that, when flowing through electromagnet 364, generates a magnetic flux density equal to the set point at measured working gap 368.

In an exemplary embodiment, generating the magnetic field may further include applying a voltage to the electromagnet causing the calculated amount of current to flow through the electromagnet. For example, memory 2802 may further include instructions, that, when executed, cause processor 2804 to adjust an output voltage of variable transformer 284 by actuating variable transformer 284 utilizing actuator 282 to the voltage that may cause the calculated amount of current to flow through electromagnet 2222.

In an exemplary embodiment, step 406 of adjusting a magnetic flux density of the magnetic field based on the measured working gap between the outer surface of the workpiece and the magnetic abrasive brush may be implemented in PLC 280 using hardware, software, firmware, tangible computer readable media having instructions stored thereon, or a combination thereof and may be implemented in one or more computer systems or other processing systems.

In an exemplary embodiment, PLC 280 may be a commercially available processing platform or a special purpose device. Exemplary embodiments of the present disclosure may be practiced with various computer system configurations, including multi-core multiprocessor systems, minicomputers, mainframe computers, computers linked or clustered with distributed functions, as well as pervasive or miniature computers that may be embedded into virtually any device.

For instance, a computing device having at least one processor device similar to processor 2804 and a memory similar to memory 2802 may be used to implement the above-described embodiments. In an exemplary embodiment, processor 2804 may be a single processor, a plurality of processors, or combinations thereof. Processor devices may have one or more processor "cores."

In an exemplary embodiment, the disclosed methods may be implemented utilizing other computer systems and/or computer architectures. Although operations may be described as a sequential process, some of the operations may, in fact, be performed in parallel, concurrently, and/or in a distributed environment, and with program code stored locally or remotely for access by single or multiprocessor machines. In addition, in some embodiments the order of operations may be rearranged without departing from the spirit of the disclosed subject matter.

In an exemplary embodiment, processor 2804 may be a special purpose or a general-purpose processor device. As will be appreciated by persons skilled in the relevant art, processor 2804 may also be a single processor in a multi-core/multiprocessor system, such system operating alone, or in a cluster of computing devices operating in a cluster or server farm. In an exemplary embodiment, memory 2802 may include a main memory such as a random access memory (RAM), and may further include a secondary memory such as a hard disk drive and a removable storage drive. In an exemplary embodiment, removable storage drive may include a floppy disk drive, an optical disk drive, a flash memory, or the like. In an exemplary embodiment, removable storage drive may read from and/or write to a removable storage unit in a well-known manner. In an exemplary embodiment, removable storage unit may include a floppy disk, an optical disk, a flash memory, or the like, which may be read by and written to by removable storage drive. In an exemplary embodiment, removable storage unit may include a computer useable storage medium having stored therein computer software and/or data.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A system for magnetic abrasive finishing of a workpiece, the system comprising:

a magnetic abrasive brush comprising:

a plurality of magnetic/abrasive particles; and an electromagnet configured to apply a magnetic field on the plurality of magnetic abrasive particles;

a first actuating mechanism configured to actuate a rotational movement of the workpiece about a longitudinal axis of the workpiece;

a second actuating mechanism configured to actuate a linear movement of the magnetic abrasive brush in a first direction relative to the workpiece, the first direction parallel to the longitudinal axis of the workpiece;

a sensor coupled with the magnetic abrasive brush, the sensor configured to measure a working gap between the magnetic abrasive brush and an outer surface of the workpiece at any given instant as the magnetic abrasive brush moves linearly, the working gap comprising a distance, between a center of the magnetic field and the outer surface of the workpiece, along a first axis perpendicular to the longitudinal axis of the workpiece; and a control unit coupled to the magnetic abrasive brush, the control unit configured to adjust a magnetic flux density of the magnetic field based on the measured working gap at any given instant.

2. The system according to claim 1, wherein the control unit comprises:

a processor; and a memory coupled to the processor, the memory configured to store executable instructions to cause the processor to:

receive, via a user interface, a set point for the magnetic flux density;

receive the working gap at a given instant; and calculate an amount of electric current that, when flowing through the electromagnet, generates an adjusted magnetic flux density at the received working gap at the given instant, the adjusted magnetic flux density equal to the set point.

3. The system according to claim 2, wherein the memory is further configured to store executable instructions to cause the processor to calculate the amount of electric current by operations defined by:

$$I = \frac{2B(R^2 + x^2)^{3/2}}{\mu_0 R^2}$$

where:

$\mu_0$ is a vacuum permeability constant equal to $1.2566370614\times10^{-6}$ N/A$^2$;

I is an amount of electric current;

B is a set point for the magnetic flux density;

R is a coil radius of the electromagnet; and x is a working gap.

4. The system according to claim 2, wherein the memory is further configured to store executable instructions to cause the processor to apply a voltage to the electromagnet to cause the calculated amount of electric current to flow through the electromagnet.

5. The system according to claim 1, wherein the electromagnet comprises:

a magnetic core; and a magnetic coil wound around the magnetic core, the magnetic coil coupled to an electric power source via a variable transformer.

6. The system according to claim 5, wherein the control unit is further coupled with the variable transformer and configured to adjust the magnetic flux density of the magnetic field based on the measured working gap at any given instant by adjusting an output voltage of the variable transformer based on the measured working gap at any given instant.

7. The system according to claim 1, wherein the sensor comprises:

a linear variable differential transformer (LVDT) comprising a ferromagnetic coil;

a sensor rod coupled to the ferromagnetic core from a first end; and a sensor tip coupled with the sensor rod from a second opposing end, the sensor tip movable on the outer surface of the workpiece, wherein the LVDT is configured to measure a distance between the sensor tip and a reference point.

8. The system according to claim 7, wherein the workpiece is axially symmetric about the longitudinal axis of the workpiece, and wherein a perpendicular distance between the reference point and the longitudinal axis of the workpiece is equal to a perpendicular distance between the center of the magnetic field generated in the electromagnet and the longitudinal axis of the workpiece.

9. The system according to claim 8, wherein the sensor is mounted in line with the abrasive magnetic brush along the first axis at an opposite side of the workpiece.

10. The system according to claim 1, wherein the workpiece is axially symmetric about the longitudinal axis of the workpiece, the longitudinal axis comprising a main axis of the workpiece.

11. A method for magnetic abrasive finishing of a workpiece, the method comprising:

sweeping an outer surface of the workpiece by a magnetic abrasive brush, the magnetic abrasive brush comprising:

a plurality of magnetic abrasive particles; and an electromagnet configured to apply a magnetic field on the plurality of magnetic abrasive particles, wherein sweeping the entire area of the outer surface of the workpiece comprises:

actuating a rotational movement of the workpiece relative to the magnetic abrasive brush about a longitudinal axis of the workpiece; and actuating a linear translational movement of the magnetic abrasive brush relative to the workpiece along a first axis parallel with the longitudinal axis of the workpiece;

measuring a working gap between the outer surface of the workpiece and the magnetic abrasive brush, the working gap comprising a distance between the outer surface of the workpiece and a center of the magnetic field generated in the electromagnet along a second axis perpendicular to the longitudinal axis of the workpiece, wherein measuring the working gap comprises associating a linear displacement sensor with the workpiece; and adjusting a magnetic flux density of the magnetic field based on the measured working gap between the outer surface of the workpiece and the magnetic abrasive brush.

12. The method according to claim 11, wherein adjusting the magnetic flux density of the magnetic field based on the measured working gap comprises:

receiving a set point for the magnetic flux density; and generating the magnetic field with a magnetic flux density equal to the set point at a distance from the magnetic abrasive brush along the second axis, the distance equal to the measured working gap.

13. The method according to claim 12, wherein generating the magnetic field comprises:

calculating an amount of electric current that, when flowing through the electromagnet, generates a magnetic flux density equal to the set point at the measured working gap; and applying a voltage to the electromagnet causing the calculated amount of current to flow through the electromagnet.

14. The method according to claim 13, wherein calculating the amount of electric current comprises operations defined by:

$$I = \frac{2B(R^2 + x^2)^{3/2}}{\mu_0 R^2}$$

where:

$\mu_0$ is a vacuum permeability constant equal to $1.2566370614\times10^{-6}$ N/A$^2$;

I is an amount of electric current;

B is a set point for the magnetic flux density;

R is a coil radius of the electromagnet; and x is a working gap.

15. The method according to claim 11, wherein associating the linear displacement sensor with the workpiece comprises associating the linear displacement sensor with an axially symmetric workpiece, the linear displacement sensor comprising:

a linear variable differential transformer (LVDT) comprising a ferromagnetic coil;

a sensor rod coupled to the ferromagnetic core from a first end; and a sensor tip coupled with the sensor rod from a second opposing end, the sensor tip movable on the outer surface of the workpiece, wherein the LVDT is configured to measure a distance between the sensor tip and a reference point, and wherein associating the linear displacement sensor with an axially symmetric workpiece comprises mounting the linear displacement sensor adjacent the workpiece such that a perpendicular distance between the reference point and the longitudinal axis of the workpiece is equal to a perpendicular distance between the center of the magnetic field generated in the electromagnet and the longitudinal axis of the workpiece.

16. The method according to claim 15, wherein associating the linear displacement sensor with an axially symmetric workpiece further comprises mounting the linear displacement sensor in line with the abrasive magnetic brush along the first axis at an opposing side of the workpiece.

* * * * *